United States Patent [19]

Widmaier

[11] 4,303,152

[45] Dec. 1, 1981

[54] FEEDER TABLE

[76] Inventor: Theo Widmaier, Ludwigstr. 15, 8191 Königsdorf, Fed. Rep. of Germany

[21] Appl. No.: 136,559

[22] Filed: Apr. 2, 1980

[30] Foreign Application Priority Data

Apr. 5, 1979 [DE] Fed. Rep. of Germany ..... 2913786

[51] Int. Cl.[3] ..... B65G 25/00; B65G 37/00; B65H 31/34

[52] U.S. Cl. ..... 198/485; 198/746; 271/147; 271/161

[58] Field of Search ..... 198/746, 743, 737, 488, 198/485, 739; 271/37, 149, 148, 157, 161, 3, 4, 269; 83/90, 93

[56] References Cited

U.S. PATENT DOCUMENTS 924,637 6/1909 Ooy ..... 271/148

2,656,961 10/1953 Beuington ..... 271/148

2,687,070 10/1954 Gastright ..... 271/148

4,188,026 2/1980 Nagai ..... 271/148

FOREIGN PATENT DOCUMENTS 623125 11/1935 Fed. Rep. of Germany ..... 271/147

*Primary Examiner*—Robert B. Reeves

*Assistant Examiner*—Brian Bond

*Attorney, Agent, or Firm*—Andrus, Sceales, Starke & Sawall

[57] ABSTRACT

A feeder table for laminar stacked objects has a thrust member for supplying stacks to a processing machine. An arcuate slide path for the stacks extends between the table and the machine. The thrust member follows the arcuate path to separate the objects by deforming the stack. The stack is placed against a stop member for supply to the machine.

7 Claims, 4 Drawing Figures

FEEDER TABLE

Figure 1:
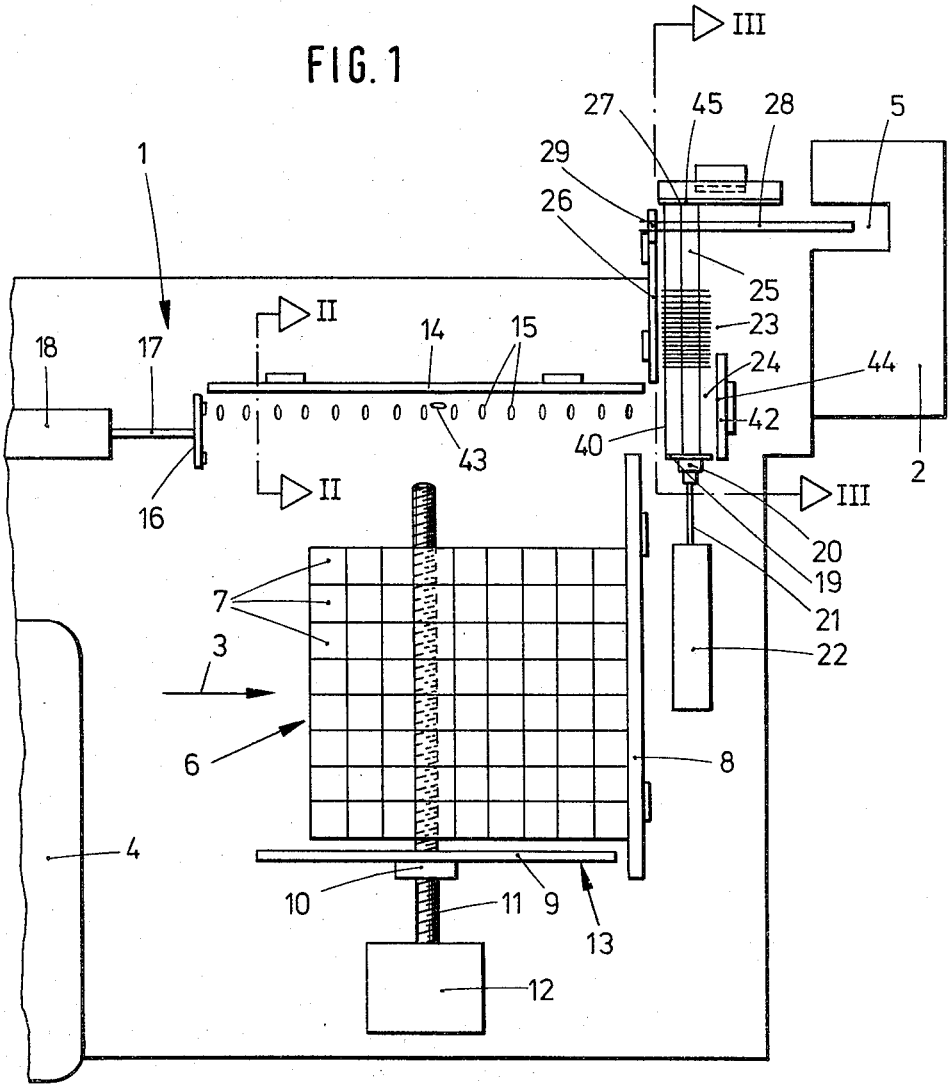

This invention relates to a feeder table of the type set forth in the introductory clause of the main claim.

A feeder table of this type is known from DE-GM 76 40 117. In the embodiment described therein, a second pusher member in the form of a fork actuated by means of a piston rod is employed for advancing a row of blank stacks to a position in front of an input pusher member which is movable parallel and opposite to the pusher rail for introducing the entire row of blank stacks into parallel work stations, in this case stamping or labelling stations. The input pusher member of this feeder table moves in the same plane as the remaining pushers. This feeder table is unsuitable for functional interoperability with a machine in which the receiving zone is vertically offset or inclined with respect to the support plane of the table, and in which moreover only individual blank stacks are to be further processed.

It is an object of the present invention to improve a feeder table of the above defined type in such a manner that individual blank stacks can be separated from a blank stack group and conveyed to the receiving zone of a machine which is vertically offset and/or inclined with respect to the support plane of the table. Particularly in the case of the blank stack groups being supplied by a planar cutting machine for stacked sheets it is intended that operation of the feeder table causes the two-dimensional objects or blank sheets adhering to one another in each blank stack due to the planar cutting action to be separated from one another, so that the further processing of the blank stack, as for instance in a contour label punching machine, is no longer hampered by the undesired coherence of the two-dimensional objects.

The invention proceeds from the recognition that due to the cutting of stacked sheets in a planar cutting machine, the two-dimensional objects in each blank stack have a tendency, resulting from the formation of cutting burrs or from the compression of the stacked objects during the cutting operation, to adhere to one another, so that the cut blank stack shows undesirable cohesion properties which may interfere with the further processing in the contour label punching machine, due to the difficulty of properly positioning the coherent blank stack with respect to the punching die.

The above problem is solved according to the invention by a feeder table having the characteristics set forth in the characterizing clause of the main claim.

The feeder table according to the invention enables individual blank stacks to be supplied to a processing machine at selected intervals. During movement of each blank stack along the slide path, the deformation thereof caused by the thrust member results in the individual blanks being separated from one another. This was formerly accomplished by an operator gripping each blank stack in his hand and separating the blanks from one another by repeatedly running their edges over his thumb. The hinged connection between the thrust member and its actuator ensures that the thrust member closely follows the slide path, so that the blank stack after its deformation is realigned against the stop member in the receiving zone, enabling it to be properly introduced into the machine. These features of the invention permit not only to eliminate additional manual labour, but also to obtain a rapid sequence of blank stacks in which the individual blanks are separated from one another. The invention thus results in an improved utilization of the high capacity of modern machines for processing the blank stacks, as compared to the employ of conventional feeder tables. The feeder table according to the invention is of simple construction and functionally reliable, and may be readily combined with a great number of processing machines of the type in question. Depending on the arrangement and design of the receiving zone of the machine, which may be inclined or vertically offset with respect to the support plane of the table, the feeder table may be readily adapted to the prevailing conditions by suitably designing the slide path, with the support plane of the feeder table being always horizontal and thus in the most suitable position for the separation of the individual blank stacks.

An advantageous embodiment of the feeder table according to the invention is set forth in claim 2. Irrespective of the length of the slide path, there has to be provided only a single arcuate portion for separating the cohering two-dimensional objects in each stack from one another. Upstream and downstream of the arcuate portion the blank stacks are advanced along rectilinear portions of the slide path. This is a particular advantage of the feeder table according to the invention, inasmuch as its adaptation to different processing machines can be accomplished by providing correspondingly modified arcuate portions of the slide path.

A further preferred embodiment of the subject matter of the application is disclosed in claim 3. The provision of said guide means ensures that the blank stack cannot turn on the slide path during its deformation, and prevents the individual two-dimensional blanks from being angularly displaced relative to one another, which would otherwise result in a disarranged stack being supplied to the receiving zone of the machine.

A still further advantageous embodiment of the subject matter of the application is disclosed in claim 4. The simple hinged connection between the thrust member and the piston rod of its actuator permits the thrust member to closely follow the contour of the slide path and to effect the deformation as well as the subsequent realignment of the blank stack without the piston rod deviating from its linear movement. The actuation of the thrust member may therefore be carried out by a simple cylinder-piston rod arrangement.

Another advantageous embodiment of the subject matter of the application is set forth in claim 5. The described arrangement ensures a uniformly guided movement of the thrust member, and prevents the lowermost blanks in the stack from slipping underneath the thrust member. At the same time, the guide grooves of the slide path reduce the contact surface for the stack, so that it is conveyed with reduced frictional resistance.

Claim 6 specifies a further advantageous embodiment of the feeder table according to the application. This feeder table is specifically designed for separating individual blank stacks from a blank stack group supplied by a planar cutting machine at irregular intervals and to feed such separated blank stacks to an associated machine at selected intervals. By the employ of suitable control means the table may be arranged for substantially fully automatic operation. If the planar cutting machine is not directly connected to the feeder table, its operation requires no more than a single operator for transferring the blank stack groups onto the feeder table and aligning them against the first stop wall.

Still another advantageous embodiment of the subject matter of the application is finally disclosed in claim 7. The employ of the control means disclosed in this claim ensures a timed sequence of operation of the different assemblies, so that there is no danger of interfering during separation and feeding of the blank stacks.

Figure 2:
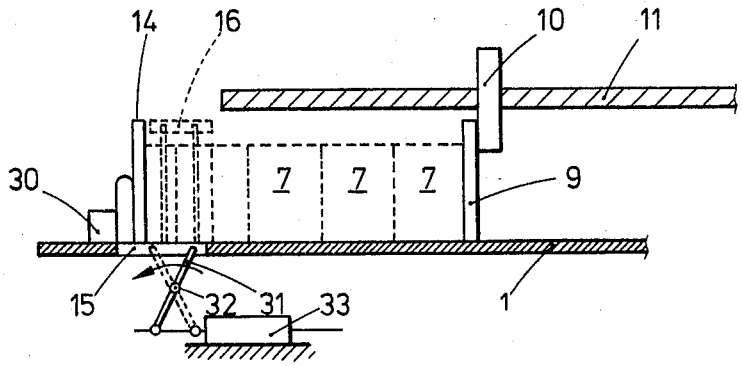
Figure 3A:
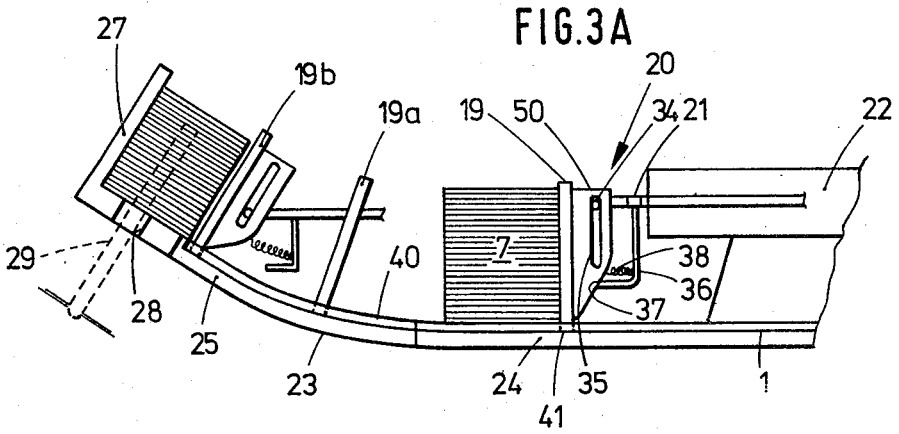
Figure 3B:
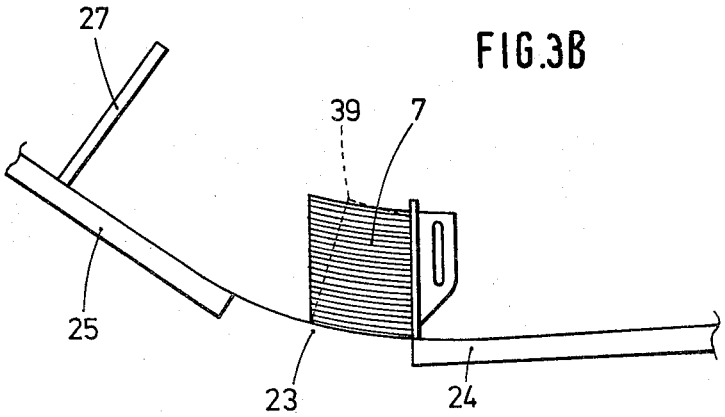

An embodiment of the feeder table according to the application shall now be described with reference to the accompanying drawings, in which FIG. 1 shows a top plan view of a feeder table cooperating with a machine, FIG. 2 shows a partial cross-sectional view of the table shown in FIG. 1 taken in the direction of arrows II—II therein, FIG. 3*a* shows a further cross-sectional view taken in the plane III—III in FIG. 1 and showing a separated blank stack in different positions, and FIG. 3*b* shows a view corresponding to FIG. 3*a* with the blank stack deformed by the thrust member in an intermediate position thereof.

A feeder table 1 shown in FIG. 1 is located upstream of a machine 2. In the direction of an arrow 3, table 1 is supplied by an upstream machine, for instance a planar cutting machine 4, with individual blank stack groups 6 consisting of several rows of individual blank stacks 7, which are to be fed to the receiving zone 5 of downstream machine 2. Each blank stack group 6 consists of stacked sheets of for instance paper, cardboard or plastic, which have been cut by the planar cutting machine 4 in a pattern corresponding to the individual blank stacks 7.

Each blank stack group 6 is initially pushed onto the feeder table 1 and aligned against a stationary first stop wall 8. A first pusher member 9 extending perpendicular to first stop wall 8 is movable in the direction of arrow 13 by means of a travelling nut 10 carried on a threaded shaft 11 rotated by a drive source 12. Opposite pusher member 9 there is provided a second stop wall 14, in front of which table 1 is formed with openings for a separating device (not shown in detail). A second pusher member 16 is movable along the front side of second stop wall 14 towards a third stop wall 42 by means of the piston rod 17 of an actuating cylinder 18. Located at the rear of first stop wall 8 is a third pusher or thrust member 19 connected through a hinge 20 to the piston rod 21 of an actuating cylinder 22 for movement parallel to the path of first pusher member 9. Thrust member 19 is adapted for movement along a slide path 23, 24, 25 towards the receiving zone 5 of machine 2, said receiving zone 5 being inclined at an angle relative to the support plane of table 1, as shown in FIGS. 3*a* and 3*b*. Slide path 23, 24, 25 has an arcuate portion 23 as indicated in FIG. 1 by cross-hatching. A guide wall 26 extends along one side of the slide path. The end of the slide path is defined by a stop 27 rising vertically thereabove. In receiving zone 5 of machine 2, the slide path 23, 24, 25 is traversed by a slot 28, through which a feeder member 29 is raised at timed intervals for movement transversely of the slide path. The slide path 23, 24, 25 is formed with guide grooves extending up to stop 27. Detectors 43, 44 and 44 are provided for controlling the sequential operation of pushers 16, 17 and feeder member 29.

The cross-sectional view of FIG. 2, taken along the line II—II in FIG. 1, shows the separation of one blank stack row from the blank stack group 6. Disposed below the support plane of table 1 is a separating assembly comprising a number of fingers 31 pivoted on a shaft 32 for actuation by a actuator cylinder 33. During the pivotal movement of fingers 31, their tips project above the surface of feeder table 1. The second stop wall 14 is suitably mounted on table 1 by means of adjustable supports 30.

The separation of the leading blank stack row in the direction of arrow 13 is carried out as follows: The first pusher member 9 advances the blank stack group 6 in the direction of arrow 13, until the leading blank stack row is located at a selected distance opposite second stop wall 14. Subsequently shaft 32 carrying fingers 31 is rotated by actuator cylinder 33, so that the finger tips engage the leading blank stack row to advance it into engagement with the stop wall. The distance previously existing between the stop wall and the forward surface of the leading stack row is now present between this row and the remainder of the blank stack group. Subsequently the second pusher member 16 (shown in broken lines in FIG. 2) advances the separated blank stack row along the second stop wall until the leading blank stack 7 engages the third stop wall 42, whereupon actuation of the third pusher or thrust member 19 is initiated under the control of detector 44. This condition is shown in FIG. 3*a*.

FIG. 3*a* shows the manner in which thrust member 19 is connected to piston rod 21 through hinged connection 20. Piston rod 21 carries a transverse pin 34 engaging a vertical slot 35 of a bracket 50 attached to the rear surface of thrust member 19. Piston rod 21 further carries an L-shaped stop member engaging a stop surface 37 of bracket 50 in the normal position of thrust member 19, towards which position it is biased by a spring 38 as shown in FIG. 3*a*. The lower edge of thrust member 19 is formed with projections 41 for engagement with the guide grooves 40 of slide path 23, 24, 25.

Actuating cylinder 22 is activated by a signal generated by detector 44 to move thrust member 19 along slide path 23, 24, 25 towards end stop 27. By this movement the leading blank stack is initially pushed along the rectilinear portion 24 of the slide path, and subsequently along the arcuate portion 23 thereof. During movement along this portion, thrust member 19 exerts a deforming force on the blank stack, whereby the stack is deformed to the shape of a parallelogram as shown in FIG. 3*b*. Due to this deformation, the cohesion of the two-dimensional objects in the stack, i.e. their resistance against parallel displacement relative to one another is cancelled. In this manner, each of the two-dimensional blanks contained in stack 7 is displaced relative to the adjacent ones. During passage along arcuate portion 23, the blank stack would tend to retain its original shape indicated in broken lines in FIG. 3*b*, it is however deformed to the shape indicated in solid lines. After the blank stack 7 has been deformed in the described manner, thrust member 19 enters arcuate section 23 of the glide path. During passage along this portion, the resistance exerted by blank stack 7 causes thrust member 19 to be tilted to a position 19*a* substantially radial to arcuate portion 23. At the same time, the slide and tilt hinge 20 permits thrust member 19 to be raised above the support plane of table 1 as shown in FIG. 3*a*. After having been pushed along arcuate section 23, blank stack 7 is advanced along the inclined, rectilinear portion 25 of the slide path, until it abuts end stop 27 raising substantially vertical above this end portion of the slide path. In the meantime the point of attack of pin 34 has travelled downwards in slot 35 to a position in which the prevailing kinematic conditions permit the thrust member to tilt to a position 19*b* parallel to end stop 27. Further pressure exerted by piston rod 21 results in the deformation of blank stack 7 indicated in FIG. 3*b* being completely cancelled, so that the stack is again properly aligned. The individual two-dimensional blanks contained in the stack are now fully separated from one another, and are thus in optimum condition for further processing by machine 2. In the forward end position 19*b* of the thrust member shown in FIG. 3*a*, detector 45 generates a signal causing feeder member 29 to feed blanks stack 7 into machine 2. Feeding member 29 performs an arcuate movement in the course of which it projects upwards through slot 28 to advance stack 7 towards machine 2. After feeder member 29 has returned to its original position, thrust member 19 can again be actuated as soon as detector 44 generates a further signal.

If the machine to which the blank stacks are to be fed has a horizontally disposed receiving zone, the slide path preferably comprises a further, oppositely curved arcuate portion downstream of arcuate portion 23 connecting the latter to the receiving zone. In this case, the blank stack advanced by thrust member 19 is subjected to a wave-shaped deformation for separating the individual two-dimensional objects from one another, and is then again realigned against end stop 27.

I claim:

1. A feeder table for a machine for processing two-dimensional objects in stacked arrangement, particularly for a label punching machine, comprising a thrust member for supplying individual pre-cut blank stacks to the receiving zone of said machine, characterized in that said receiving zone (5) of said machine (2) is vertically offset and/or inclined with respect to the plane of said table (1), that an upwardly directed arcuate slide path (23, 24, 25) extends between the plane of the feeder table and said receiving zone, that said thrust member (19) is adapted for movement along said slide path towards said receiving zone and is connected to an associated drive source (21, 22) for vertical movement and tilting movement about an axis (34) extending parallel to the table plane and transversely of the thrust direction, so that during transfer of a blank stack (7) along the arcuate portion (23) of said slide path it exerts a force on said stack tending to deform it by displacing the two-dimensional objects therein relative to one another parallel to the plane thereof, and is then automatically tilted to a position in which it is disposed substantially radial with respect to the arcuate portion of said slide path so as to align the blank stack against a stop member (27) defining said receiving zone and extending perpendicularly above said slide path.

2. A feeder table according to claim 1, characterized in that the receiving zone (5) of said machine (2) is planar and in an inclined position with respect to the plane of the table (1), and that said slide path (23, 24, 25) comprises an arcuate portion (23) merging tangentially with said table plane and said receiving zone.

3. A feeder table according to claim 1, characterized in that guide means (26) for individual blank stacks (7) is provided on at least one side of said slide path (23, 24, 25).

4. A feeder table according to claim 1, wherein said thrust member is actuated by the piston rod of an actuating cylinder, characterized in that said thrust member (19) is connected to the end of said piston rod (21) by means of a tilt and slide joint (20) and biased by a spring (38) towards it normal position perpendicular to the plane of the feeder table (1).

5. A feeder table according to claim 1, characterized in that said slide path (23, 24, 25) is formed with guide grooves (40) engaged by projections (41) at the lower edge of said thrust member.

6. A feeder table according to claim 1, adapted to receive individual blank stack groups in a planar and regular arrangement from an upstream station, particularly a planar cutting machine for stacked sheets, said feeder table comprising a support plane for at least one blank stack group, a linearly movable first pusher member for advancing said blank stack group along a first stop wall towards a position, in which the leading row of blank stacks is disposed at a predetermined distance opposite a second stop wall, a separating device for separating the leading row of blank stacks from the remainder of the blank stack group, a second pusher member disposed for movement along said second stop wall for advancing the separated row of blank stacks towards a third pusher member or thrust member actuable transversely of the direction of movement of said second pusher member, characterized in that said second pusher member (16) is adapted to be advanced in consecutive steps corresponding to the width of a single blank stack (7), that a third stop wall (42) is provided in alignment with the travel path of said second pusher member, and that said slide path (23, 24, 25) extends parallel to the travel path (13) of said first pusher member (9) and to the rear of said second stop wall (14) towards said receiving zone (5), said third pusher member (19) being said thrust member of the feeder table.

7. A feeder table according to claim 6, characterized in that said third stop wall (42) and said stop member (27) are provided with detector means (44, 45) for controlling the operation of said thrust member (19) and of a input conveyor means (29) of said machine (2).

* * * * *